US008182031B1

(12) United States Patent
MacKenzie

(10) Patent No.: US 8,182,031 B1
(45) Date of Patent: May 22, 2012

(54) POKER KIT WITH CHAIRS AND TABLE

(76) Inventor: Eric K. MacKenzie, Oshawa (CA)

( * ) Notice: Subject to any disclaimer, the term of this patent is extended or adjusted under 35 U.S.C. 154(b) by 89 days.

(21) Appl. No.: 12/694,956

(22) Filed: Jan. 27, 2010

(51) Int. Cl.

| | |
|---|---|
| ***A47C 4/00*** | (2006.01) |
| ***A47C 4/10*** | (2006.01) |
| ***A47C 7/62*** | (2006.01) |
| ***A47B 3/00*** | (2006.01) |
| ***A47B 3/08*** | (2006.01) |
| ***A47B 3/10*** | (2006.01) |
| ***A47B 3/14*** | (2006.01) |
| ***A47B 13/08*** | (2006.01) |
| ***A47B 13/10*** | (2006.01) |
| ***A47B 83/02*** | (2006.01) |

(52) U.S. Cl. ..... 297/135; 297/16.1; 297/17; 297/51; 297/53; 297/54; 297/188.01; 297/188.14; 297/188.15; 108/90; 108/125; 108/129

(58) Field of Classification Search ..... 297/16.1–50, 297/188.01, 188.14–188.19, 440.1, 440.14, 297/135; 108/90, 125, 129
See application file for complete search history.

(56) References Cited

U.S. PATENT DOCUMENTS

| | | | | | |
|---|---|---|---|---|---|
| 383,255 | A | * | 5/1888 | Spaet et al. | 297/54 |
| 430,703 | A | * | 6/1890 | Spahn et al. | 297/54 |
| 885,630 | A | * | 4/1908 | Mason | 108/90 X |
| 897,737 | A | * | 9/1908 | Goodrich | 297/54 |
| 909,787 | A | * | 1/1909 | Hanley | 108/125 X |
| 920,253 | A | * | 5/1909 | Boeswinkle | 108/125 |
| 920,650 | A | * | 5/1909 | Remsen et al. | 297/54 |
| 924,396 | A | * | 6/1909 | Spoljar | 297/54 |
| 935,751 | A | * | 10/1909 | Gent | 108/125 |
| 1,118,530 | A | * | 11/1914 | Clay | 297/54 X |
| 1,180,965 | A | * | 4/1916 | Baly | 297/54 X |
| 1,235,433 | A | * | 7/1917 | Burrowes | 108/125 |
| 1,241,907 | A | * | 10/1917 | Bernhard | 297/54 |
| 1,247,644 | A | * | 11/1917 | Coffin | 108/125 |
| 1,304,540 | A | * | 5/1919 | Burrowes | 108/125 X |
| 1,306,466 | A | * | 6/1919 | Coffin | 108/125 |
| 1,370,952 | A | * | 3/1921 | Danielson | 297/54 X |
| 1,375,573 | A | | 4/1921 | Dennis | |
| 1,390,842 | A | * | 9/1921 | Szostek | 297/54 X |
| 1,401,272 | A | * | 12/1921 | Mocha | 297/54 X |
| 1,453,736 | A | * | 5/1923 | Wagner | 108/125 |
| 1,478,004 | A | * | 12/1923 | Ferguson | 108/125 |
| 1,493,467 | A | * | 5/1924 | Butt et al. | 297/54 |
| 1,535,895 | A | * | 4/1925 | Blackmore | 108/90 X |
| 1,635,279 | A | * | 7/1927 | King | 108/125 |
| 1,729,205 | A | * | 9/1929 | Cain | 297/54 X |
| 1,774,364 | A | * | 8/1930 | Gale | 108/125 |

(Continued)

FOREIGN PATENT DOCUMENTS

GB 2111827 A * 7/1983

*Primary Examiner* — Rodney B White

(57) ABSTRACT

A poker kit comprising a plurality of chairs; a cushion attached to the seat panel of the chair and a plurality of legs attached to the seat panel; a first armrest and second armrest extending from the back panel of the chair; an ashtray attached to the first armrest and a cup holder attached to the second armrest; a storage pouch attached to the arm near the ashtray; a table having an octagon shape and a felt panel attached the top; a plurality of legs attached to the table; wherein the cushions of the chair are decorated with a design of one of the four top poker hands; wherein markers are labeled on the felt on the table.

4 Claims, 4 Drawing Sheets

U.S. PATENT DOCUMENTS 1,780,394 A * 11/1930 Kalgren ..... 108/125
1,783,556 A * 12/1930 Bauer ..... 108/125
1,784,507 A * 12/1930 Walker ..... 108/125
1,803,804 A * 5/1931 Kolodny ..... 108/125 X
1,809,564 A * 6/1931 O'Connor et al. ..... 108/125 X
1,811,526 A * 6/1931 Wright ..... 108/125
1,860,644 A * 5/1932 Bales et al. ..... 108/125
1,879,945 A * 9/1932 O'Connor ..... 108/125
1,882,915 A * 10/1932 Rickson ..... 108/125
1,886,806 A * 11/1932 Hanley ..... 108/90
1,891,734 A * 12/1932 Slee ..... 108/19 X
1,900,847 A * 3/1933 Siday ..... 297/54 X
1,901,732 A * 3/1933 Clark ..... 108/125
1,904,897 A * 4/1933 Wright ..... 108/90
1,905,219 A * 4/1933 Crichton ..... 108/125
1,905,491 A * 4/1933 Null ..... 108/125
1,905,862 A * 4/1933 Harman ..... 108/125
1,910,974 A * 5/1933 Vance ..... 108/125
RE18,883 E * 6/1933 O' Connor ..... 108/125
1,944,335 A * 1/1934 Wyck ..... 297/54 X
1,950,540 A * 3/1934 Calhoun ..... 108/125
1,955,151 A * 4/1934 Shwayder ..... 108/125
1,959,950 A * 5/1934 Friedlander ..... 108/90
1,983,065 A * 12/1934 Bellows ..... 108/125
2,029,433 A * 2/1936 Mitchell ..... 108/125 X
2,044,588 A * 6/1936 Moore ..... 108/125 X
2,047,389 A * 7/1936 Sinclair ..... 108/125 X
2,072,242 A * 3/1937 Beiger ..... 108/125
2,092,441 A * 9/1937 Ciprus ..... 108/90 X
2,106,436 A * 1/1938 Pyle ..... 108/125
2,145,734 A * 1/1939 Rastetter ..... 108/125
2,174,613 A * 10/1939 Blaschke ..... 108/125 X
2,227,871 A * 1/1941 Wigell ..... 108/125 X
2,375,565 A * 5/1945 Liakopulos ..... 297/188.18 X
2,425,162 A * 8/1947 Overbey ..... 108/125
2,430,682 A * 11/1947 Merkle ..... 108/90 X
2,483,309 A * 9/1949 Amaducci ..... 297/54
2,490,367 A * 12/1949 Maddocks ..... 297/54 X
2,514,309 A * 7/1950 Burlin ..... 297/54
2,540,849 A * 2/1951 Walker ..... 108/125 X
2,545,968 A * 3/1951 Newstead ..... 297/54 X
2,586,153 A * 2/1952 Eisman ..... 108/90
2,595,845 A * 5/1952 Hagwell ..... 108/90 X
2,603,274 A * 7/1952 McClernon ..... 297/54 X
2,660,498 A * 11/1953 Norquist ..... 108/125
2,673,601 A 3/1954 Fischer et al.
2,876,825 A * 3/1959 Boortz ..... 297/54 X
2,913,040 A * 11/1959 Abajian ..... 297/54
2,936,178 A * 5/1960 Sprouse ..... 108/125 X
3,001,843 A * 9/1961 Davis ..... 108/62
3,037,831 A * 6/1962 Craddock et al. ..... 108/125
3,044,840 A * 7/1962 Hamilton ..... 108/125
3,115,108 A * 12/1963 Craddock et al. ..... 108/155
3,116,046 A * 12/1963 Risdon ..... 248/231.81
3,125,971 A * 3/1964 Wetherill ..... 108/125
3,237,575 A * 3/1966 Larson ..... 108/125
3,245,364 A * 4/1966 Weinberg ..... 108/125
3,266,445 A * 8/1966 Larson ..... 108/125
3,334,930 A * 8/1967 Larson ..... 403/65
3,464,373 A * 9/1969 Larson ..... 108/125
3,491,706 A * 1/1970 Glass ..... 108/125
3,494,661 A * 2/1970 Leyburn ..... 297/153
3,557,856 A * 1/1971 Berman ..... 108/90
3,637,184 A * 1/1972 O'Brien ..... 297/188.17 X
3,638,587 A * 2/1972 Uyeda et al. ..... 108/66
3,675,969 A * 7/1972 Gage ..... 297/188.18
3,744,436 A * 7/1973 Castelli et al. ..... 108/125
3,792,668 A * 2/1974 Ward ..... 108/90 X
3,807,792 A * 4/1974 Smith ..... 297/54
3,905,051 A * 9/1975 Gozdziewski ..... 297/188.14 X
3,964,403 A * 6/1976 Schankman ..... 108/90
4,144,822 A * 3/1979 Roberts et al. ..... 108/129
4,213,649 A 7/1980 Sell
4,223,945 A * 9/1980 Nikitits ..... 297/158.4
4,484,745 A * 11/1984 Sleeper ..... 108/125 X
4,798,413 A * 1/1989 Capelli ..... 297/188.18 X
4,813,675 A * 3/1989 Greenwood ..... 463/46
4,892,353 A * 1/1990 Goddard ..... 297/188.2 X
4,894,877 A * 1/1990 Marsh ..... 297/53 X
D345,767 S 4/1994 Ollington
5,350,215 A * 9/1994 DeMars ..... 297/188.14
5,474,272 A * 12/1995 Thompson et al. .. 297/188.18 X
5,567,014 A * 10/1996 Fitch ..... 297/54 X
5,722,717 A 3/1998 Rettenberger
5,845,962 A * 12/1998 Lin ..... 297/54
5,878,672 A * 3/1999 Ostermann et al. ..... 108/25 X
5,887,940 A * 3/1999 Anderson et al. .... 297/188.18 X
6,113,182 A * 9/2000 Wise ..... 297/119
6,173,660 B1 * 1/2001 Emmert ..... 108/90
6,345,861 B1 * 2/2002 Goodo ..... 297/53
6,439,659 B1 * 8/2002 Neubauer, Jr. ..... 297/188.01
RE37,927 E * 12/2002 Fitch ..... 297/54 X
6,595,143 B2 * 7/2003 London ..... 108/25
6,629,722 B1 * 10/2003 Tang ..... 297/45
6,659,021 B2 * 12/2003 Wen ..... 108/125
6,659,879 B1 * 12/2003 Cartwright ..... 108/90 X
6,712,711 B1 * 3/2004 Skelton et al. ..... 297/105 X
6,779,466 B2 * 8/2004 Shabram, Jr. ..... 108/35
6,969,112 B1 * 11/2005 Sherrill ..... 297/16.1
6,976,438 B2 * 12/2005 Lou-Hao ..... 108/129
7,052,084 B2 * 5/2006 Gillespie ..... 297/16.1 X
7,121,620 B1 * 10/2006 Fang ..... 297/51
D547,964 S 8/2007 Olano
7,273,212 B1 * 9/2007 Kolbaba ..... 273/280
7,337,728 B2 * 3/2008 Shabram, Jr. et al. ..... 108/35
7,549,702 B2 * 6/2009 Meyers ..... 297/16.1 X
7,562,930 B1 * 7/2009 Rondeau ..... 297/188.01 X
7,578,507 B2 * 8/2009 Slappay ..... 273/309
7,845,720 B2 * 12/2010 Randall ..... 297/45 X
2003/0070591 A1 * 4/2003 Shabram, Jr. ..... 108/35
2004/0103828 A1 * 6/2004 Maier et al. ..... 108/125
2004/0200390 A1 * 10/2004 Lou-Hao ..... 108/125
2005/0001380 A1 1/2005 Winter et al.
2006/0180056 A1 * 8/2006 Dorholt ..... 108/90
2006/0207482 A1 * 9/2006 Bridge et al. ..... 108/90
2007/0182221 A1 * 8/2007 McConnell et al. ..... 297/135
2007/0215011 A1 * 9/2007 Khan ..... 108/11
2009/0211496 A1 * 8/2009 Davis ..... 297/16.1 X
2010/0026057 A1 * 2/2010 Miller ..... 297/21
2010/0058958 A1 * 3/2010 Christian et al. ..... 108/19
2010/0207429 A1 * 8/2010 Quinn ..... 297/16.1
2011/0100269 A1 * 5/2011 Hull ..... 108/90
2011/0175403 A1 * 7/2011 Kinskey et al. ..... 297/16.1

* cited by examiner

FIG. 1
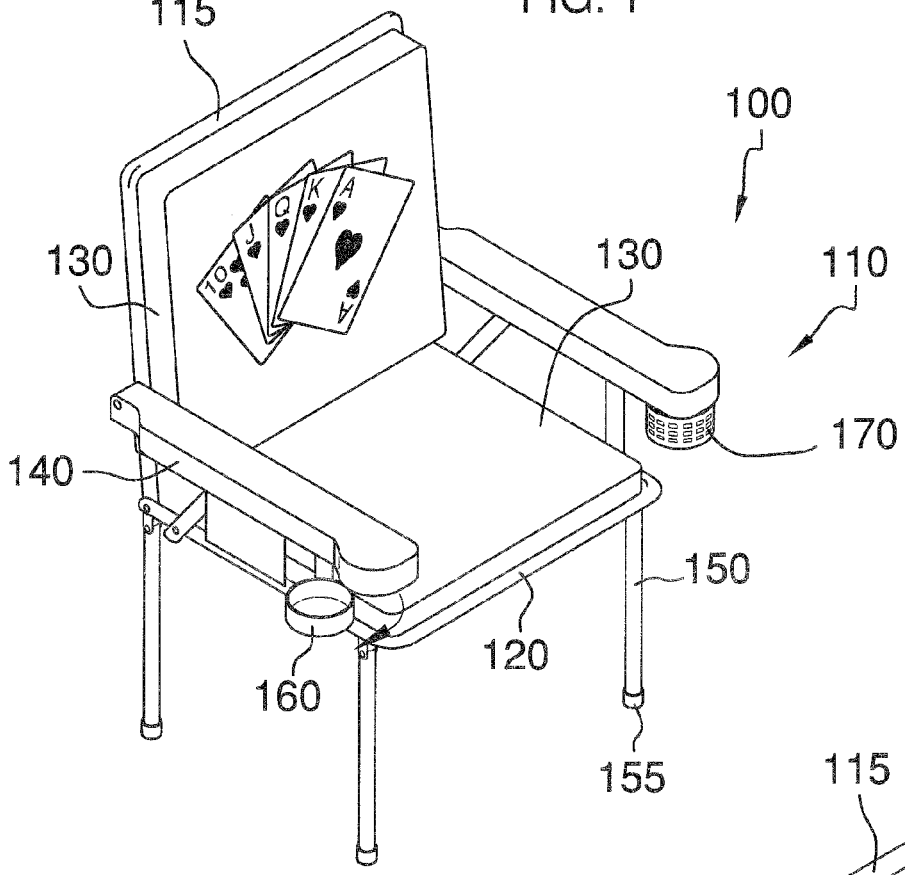
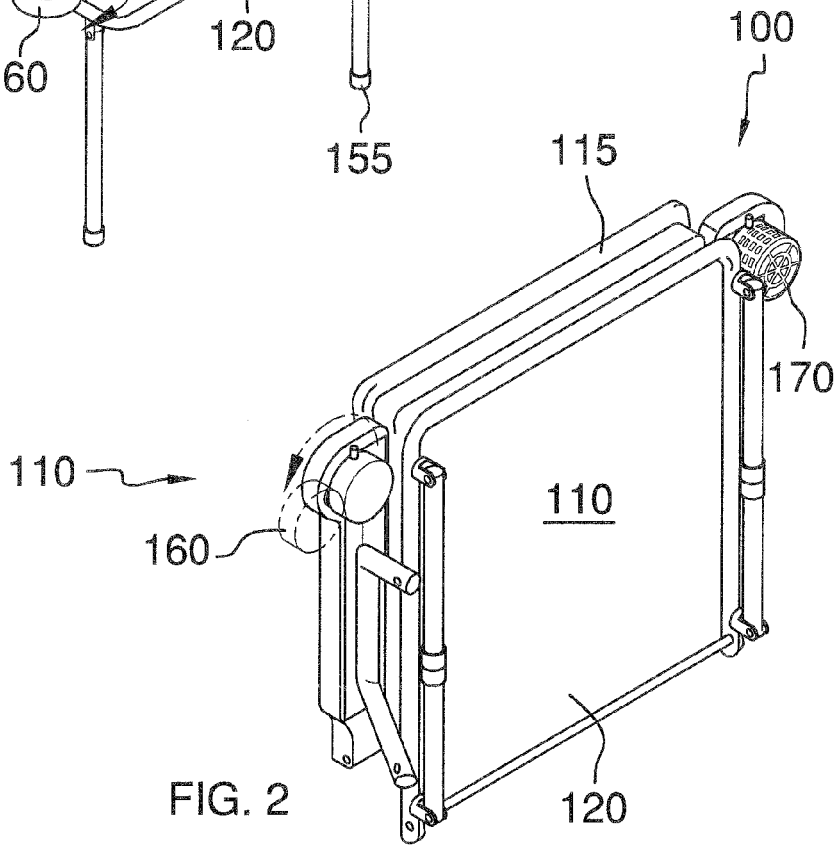
FIG. 2

POKER KIT WITH CHAIRS AND TABLE

FIELD OF THE INVENTION

The present invention is directed to a chair and a table, more particularly, to a chair and a table for use during a poker game.

BACKGROUND OF THE INVENTION

The present invention features a kit combining a novel chair and table for use during poker games.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 1 is a perspective view of a chair in the poker kit of the present invention.

FIG. 2 is a perspective view of the chair of FIG. 1, wherein the chair is in a folded configuration.

DESCRIPTION OF PREFERRED EMBODIMENTS

The following is a listing of numbers corresponding to a particular element refer to herein:
"Ultimate Poker Set"

| | |
|---|---|
| 100 | poker kit |
| 110 | chair |
| 115 | back panel |
| 120 | seat panel |
| 130 | cushion (with design of top poker hand) |
| 140 | armrest |
| 150 | leg of chair |
| 155 | rubber tip of leg of chair |
| 160 | ashtray |
| 170 | cup holder |
| 310 | design (e.g., one of the four top poker hands) |
| 510 | table |
| 511 | top surface of table |
| 512 | bottom surface of the table |
| 515 | markers |
| 520 | table leg |
| 525 | rubber tip of table leg |

Figure 3:
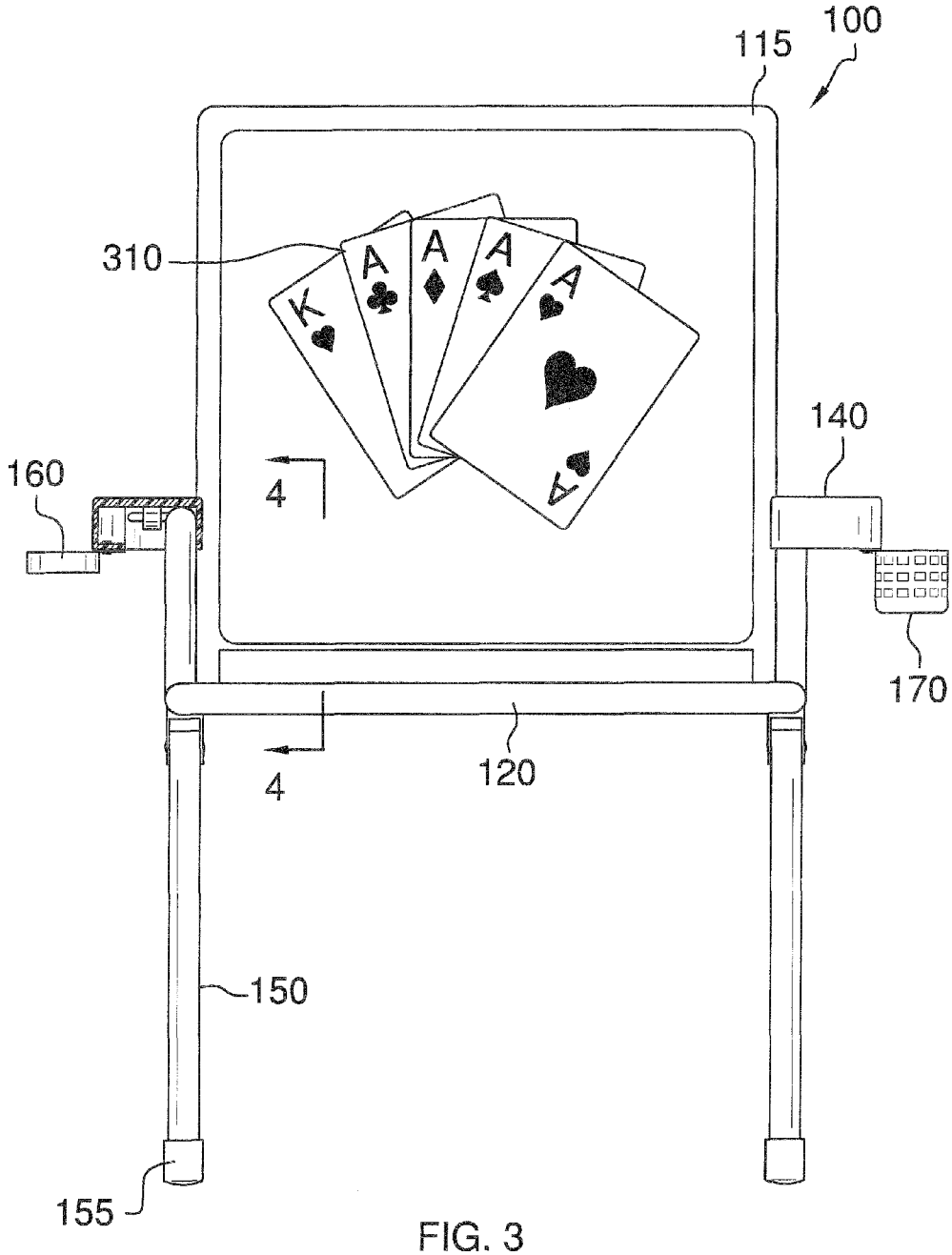
FIG. 3 is a front view of the chair of FIG. 1.
Figure 4:
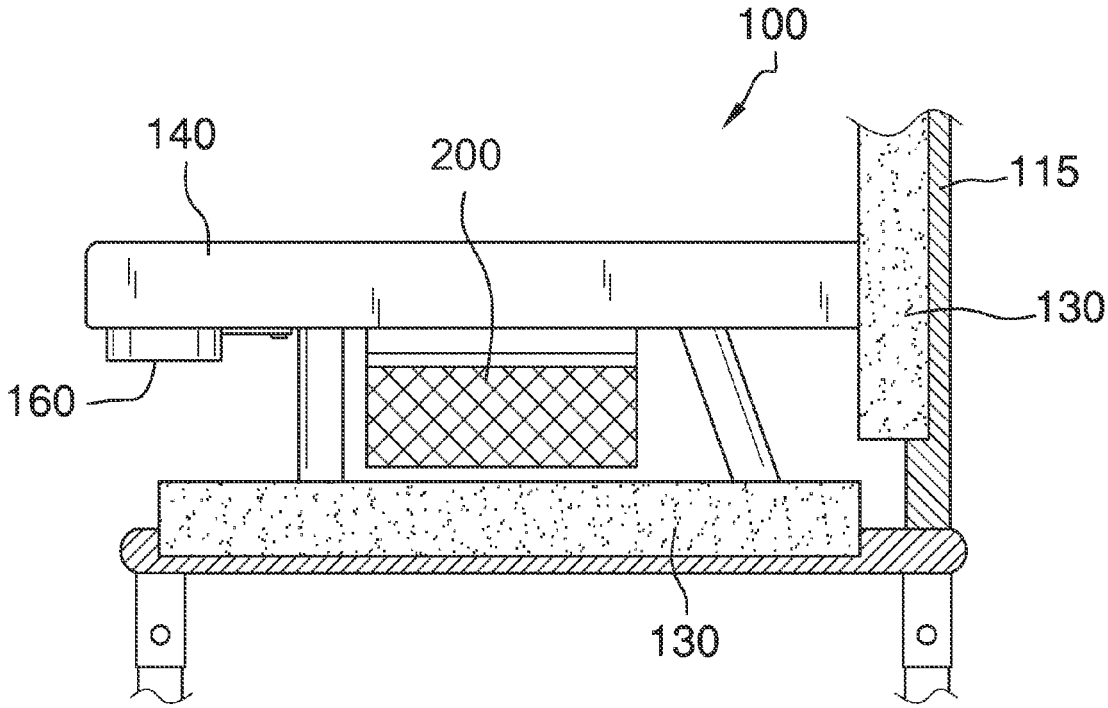
FIG. 4 is a side and cross sectional view of the chair of FIG. 1
Figure 5:
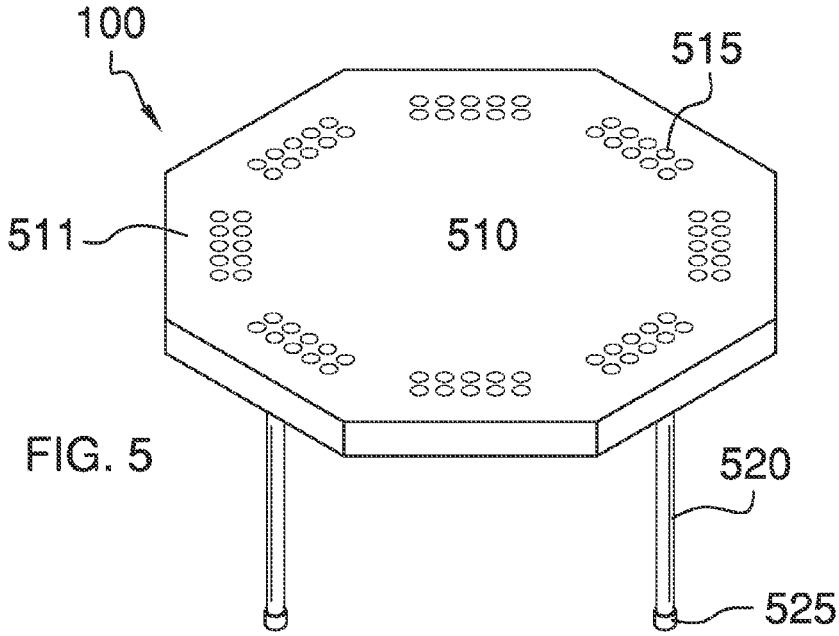
FIG. 5 is a perspective view of a table in the poker kit of the present invention.
Figure 6:
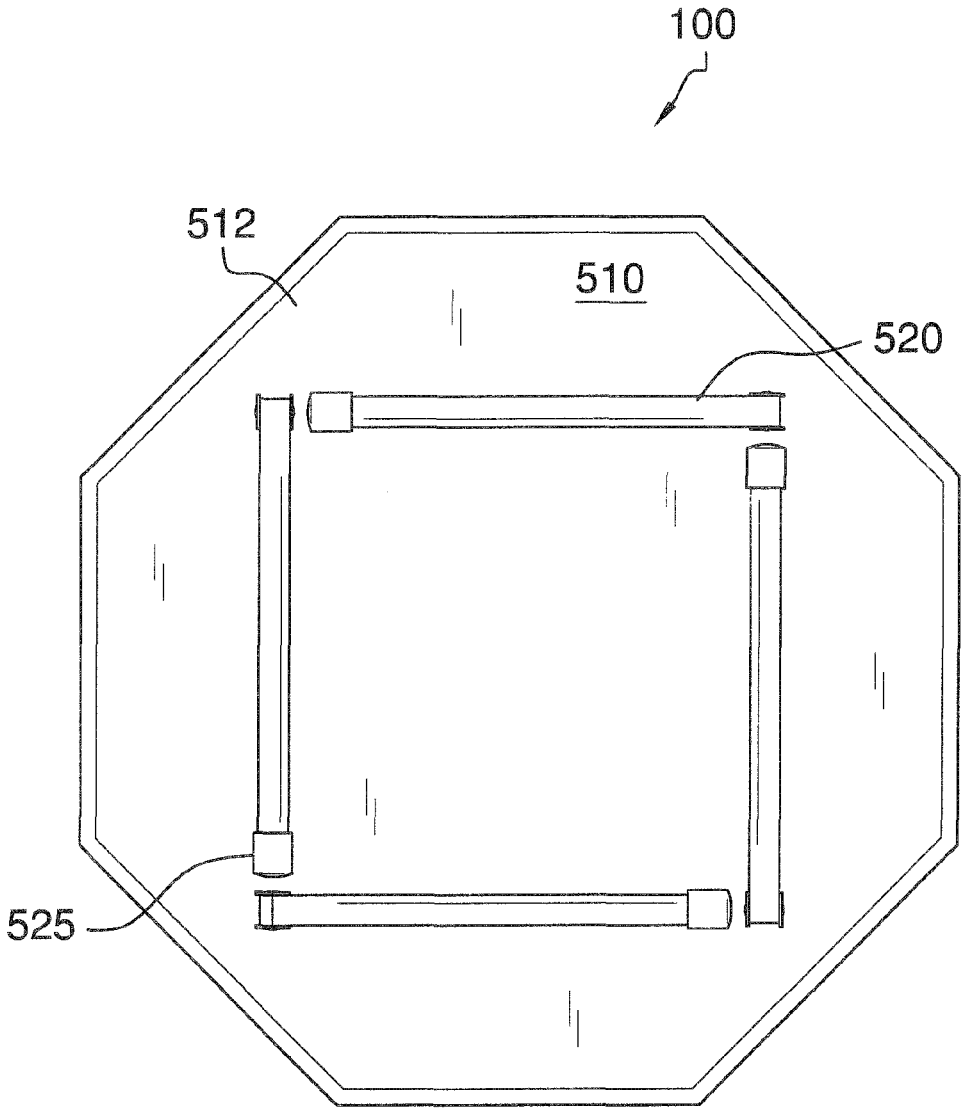
FIG. 6 is a bottom view of the table of FIG. 5.

Referring now to FIGS. 1-6, the present invention features a poker kit 100. The poker kit 100 comprises one or more chairs 110 and a table 510. In some embodiments, the kit 100 comprises 8 chairs.

The chair 110 resembles standard chairs having a back panel 115 and a seat panel 120. Attached to the seat panel 120 and to the back panel 115 is a cushion 130 for providing comfort to a user. Legs 150 are pivotally attached to the seat panel 120 of the chair 110 and are movable between an unfolded position and a folded position. Disposed on the bottom of the legs 150 is a rubber tip 155 for helping to prevent the chair 110 from slipping.

Two armrests 140 extend from the back panel 115. Attached to a first armrest 140 is an ashtray 160. Attached to a second armrest 140 is a cup holder 170. In some embodiments, a storage pouch 200 is attached to the chair, for example on an armrest 140, on the seat panel 120, on the back panel 115, or a combination thereof. In some embodiments, the storage pouch 200 is attached to the side of an arm (the right arm). The storage pouch 200 may be near the ashtray.

In some embodiments, the cushions 130 are decorated with a design. In some embodiments, the design includes a poker hand, for example a top poker hand (e.g., one of the top four poker hands possible). For example, the design may be a royal flush, a straight flush, a full house, a flush, a straight, a three of a kind, or the like. The present invention is not limited to the aforementioned poker hands.

The table 510 resembles a standard table, for example has an octagon shape. On the top surface 511 of the table 510 is a felt panel. In some embodiments, markers 515 and/or designs may be labeled on the felt.

Legs 520 are pivotally attached to the bottom surface 512 of the table 510 and are movable between an unfolded position and a folded position. Disposed on the bottom of the leas 520 is a rubber tip 525 for helping to prevent the table 510 from slipping.

The following the disclosures of the following U.S. Patents are incorporated in their entirety by reference herein: U.S. Pat. No. 2,673,601; U.S. Pat. No. 1,375,573; U.S. Pat. No. 4,213,649; U.S. Pat. No. 3,675,969; U.S. Pat. No. 6,629,722; U.S. Pat. No. 5,722,717; U.S. Pat. No. 6,227,614; U.S. Pat. Application No. 2005/0001380.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A poker kit comprising:

(a) a plurality of chairs, each chair comprising a back panel, a seat panel, a cushion attached to a top surface of the seat panel and a plurality of legs pivotally attached to a bottom surface of the seat panel; wherein the legs are movable between an unfolded position and a folded position;

(b) a first armrest and second armrest each extending from the back panel, wherein an ashtray is attached to the first armrest and a cup holder is attached to the second armrest;

(c) a storage pouch attached to the first armrest wherein the storage pouch is disposed near the ashtray;

(d) a table having an octagon shape, wherein a felt panel is attached to a top surface of the table and a plurality of legs is pivotally attached to a bottom surface of the table; wherein the legs are movable between an unfolded position and a folded position;

wherein the cushions of the chair are decorated with a design of a poker hand; wherein markers are labelled on the felt on the table.

2. The poker kit of claim 1, wherein the poker hand is a royal flush, a straight flush, a full house, a full house, a straight, or a three of a kind.

3. The poker kit of claim 1, wherein a rubber tip for helping to prevent the chair from slipping is disposed on the legs of the chair.

4. The poker kit of claim 1, wherein a rubber tip for helping to prevent the table from slipping is disposed on the legs of the table.

* * * * *